US010763594B1

(12) United States Patent
Lin

(10) Patent No.: US 10,763,594 B1
(45) Date of Patent: Sep. 1, 2020

(54) ANTENNA SYSTEM

(71) Applicant: Wistron Corp., New Taipei (TW)

(72) Inventor: Chih Peng Lin, New Taipei (TW)

(73) Assignee: WISTRON CORP., New Taipei (TW)

( * ) Notice: Subject to any disclaimer, the term of this patent is extended or adjusted under 35 U.S.C. 154(b) by 54 days.

(21) Appl. No.: 16/351,835

(22) Filed: Mar. 13, 2019

(30) Foreign Application Priority Data

Feb. 11, 2019 (TW) ..... 108104352 A

(51) Int. Cl.
*H01Q 21/00* (2006.01)
*H01Q 25/02* (2006.01)
*H01Q 21/29* (2006.01)

(52) U.S. Cl.
CPC ..... *H01Q 25/02* (2013.01); *H01Q 21/0006* (2013.01); *H01Q 21/29* (2013.01)

(58) Field of Classification Search
None
See application file for complete search history.

(56) References Cited

U.S. PATENT DOCUMENTS 5,757,319 A * 5/1998 Loo ..... H01Q 3/2605 342/375
6,191,735 B1 * 2/2001 Schineller ..... H01P 1/185 333/164
6,281,838 B1 * 8/2001 Hong ..... H01Q 3/36 333/139
6,989,788 B2 * 1/2006 Marion ..... H01P 1/185 333/164

FOREIGN PATENT DOCUMENTS

CN 106972244 A 7/2017
EP 0 840 394 B1 6/2005

OTHER PUBLICATIONS

Michler, F., et al.; "A Planar 24 GHz Switched-Beam Antenna Based on PIN Diodes for Remote Sensing Applications;" Proceedings of 2018 Asia-Pacific Microwave Conference; IEICE; 2018; pp. 1-3.
Lee, J.H., et al.; "Sector-Beam Antennas for Wide Detection Area in 79 GHz Automotive Short Range Radar(SRR) Sensor," Proceedings of 2018 Asia-Pacific Microwave Conference; IEICE; 2018; pp. 1-3.
Chinese language office action dated Dec. 17, 2019, issued in application No. TW 108104352.

* cited by examiner

*Primary Examiner* — Anh Q Tran
(74) *Attorney, Agent, or Firm* — McClure, Qualey & Rodack, LLP

(57) ABSTRACT

An antenna system includes a power divider, a first antenna array, a second antenna array, a third antenna array, a delay device, a first switch element, and a second switch element. The power divider has a first output port, a second output port, and a third output port. The first antenna array is coupled to the first output port. The second antenna array is coupled to the second output port. The third antenna array is coupled to the third output port. The first switch element determines whether to couple the first output port to the delay device according to a first control signal. The second switch element determines whether to couple the third output port to a ground voltage according to a second control signal.

17 Claims, 8 Drawing Sheets

ANTENNA SYSTEM

CROSS REFERENCE TO RELATED APPLICATIONS

This application claims priority of Taiwan Patent Application No. 108104352 filed on Feb. 11, 2019, the entirety of which is incorporated by reference herein.

BACKGROUND OF THE INVENTION

Field of the Invention

The disclosure generally relates to an antenna system, and more particularly, to an antenna system for generating different radiation patterns.

Description of the Related Art

Antenna arrays have high directivity and high gain, and they are widely used in the fields of military technology, radar detection, life detection, and health monitoring. However, if a conventional antenna array has an adjustable radiation pattern, it should use many antenna arrays and may occupy a large design space. It has become a critical challenge for current engineers to design a small-size antenna system and an antenna array thereof.

BRIEF SUMMARY OF THE INVENTION

In an exemplary embodiment, the invention is directed to an antenna system including a power divider, a first antenna array, a second antenna array, a third antenna array, a delay device, a first switch element, and a second switch element. The power divider has a first output port, a second output port, and a third output port. The first antenna array is coupled to the first output port. The second antenna array is coupled to the second output port. The third antenna array is coupled to the third output port. The first switch element determines whether to couple the first output port to the delay device according to a first control signal. The second switch element determines whether to couple the third output port to a ground voltage according to a second control signal.

In some embodiments, the delay phase of the delay device is substantially equal to 180 degrees.

In some embodiments, the first antenna array has a first feeding point. The first control signal includes a first control voltage, a second control voltage, and a third control voltage.

In some embodiments, the first switch element includes a first diode, a second diode, and a third diode. The first diode has an anode coupled to the first output port, and a cathode coupled to the first feeding point. The second diode has an anode coupled to the first node, and a cathode coupled to the first output port. The third diode has an anode coupled to a second node, and a cathode coupled to the first feeding point. The delay device is coupled between the first node and the second node.

In some embodiments, the first diode, the second diode, and the third diode are three PIN diodes controlled by the first control voltage, the second control voltage, and the third control voltage.

In some embodiments, the first switch element further includes a first inductor, a second inductor, and a third inductor. The first inductor is coupled between the first output port and the first control node. The first control node is arranged for receiving the first control voltage. The second inductor is coupled between the first node and a second control node. The second control node is arranged for receiving the second control voltage. The third inductor is coupled between the second node and a third control node. The third control node is arranged for receiving the third control voltage.

In some embodiments, the third antenna array has a third feeding point. The second control signal includes a fourth control voltage.

In some embodiments, the second switch element includes a fourth diode. The fourth diode has an anode coupled to the third output port and the third feeding point, and a cathode coupled to the ground voltage.

In some embodiments, the fourth diode is a PIN diode controlled by the fourth control voltage.

In some embodiments, the second switch element further includes a fourth inductor and a capacitor. The fourth inductor is coupled between the third output port and a fourth control node. The fourth control node is arranged for receiving the fourth control voltage. The capacitor is coupled between the fourth control node and the ground voltage.

In some embodiments, when the antenna system operates in a first mode, the first diode is turned on, and the second diode, the third diode, and the fourth diode are turned off, such that the antenna system generates a first radiation pattern including a single main beam.

In some embodiments, when the antenna system operates in a second mode, the first diode is turned off, and the second diode, the third diode, and the fourth diode are turned on, such that the antenna system generates a second radiation pattern including two different main beams.

In some embodiments, the central operation frequency of the antenna system is substantially equal to 24 GHz.

In some embodiments, each of the first antenna array, the second antenna array, and the third antenna array includes a first radiation element, a second radiation element, a third radiation element, a fourth radiation element, a fifth radiation element, a first connection element, a second connection element, a third connection element, and a fourth connection element. The first connection element is coupled between the first radiation element and the second radiation element. The second connection element is coupled between the second radiation element and the third radiation element. The third connection element is coupled between the third radiation element and the fourth radiation element. The fourth connection element is coupled between the fourth radiation element and the fifth radiation element.

In some embodiments, the first radiation element, the second radiation element, the third radiation element, the fourth radiation element, the fifth radiation element, the first connection element, the second connection element, the third connection element, and the fourth connection element are arranged in the same straight line.

In some embodiments, the length of each of the first radiation element, the second radiation element, the third radiation element, the fourth radiation element, and the fifth radiation element is substantially equal to 0.5 wavelength of the central operation frequency.

In some embodiments, the length of each of the first connection element, the second connection element, the third connection element, and the fourth connection element is substantially equal to 0.5 wavelength of the central operation frequency.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
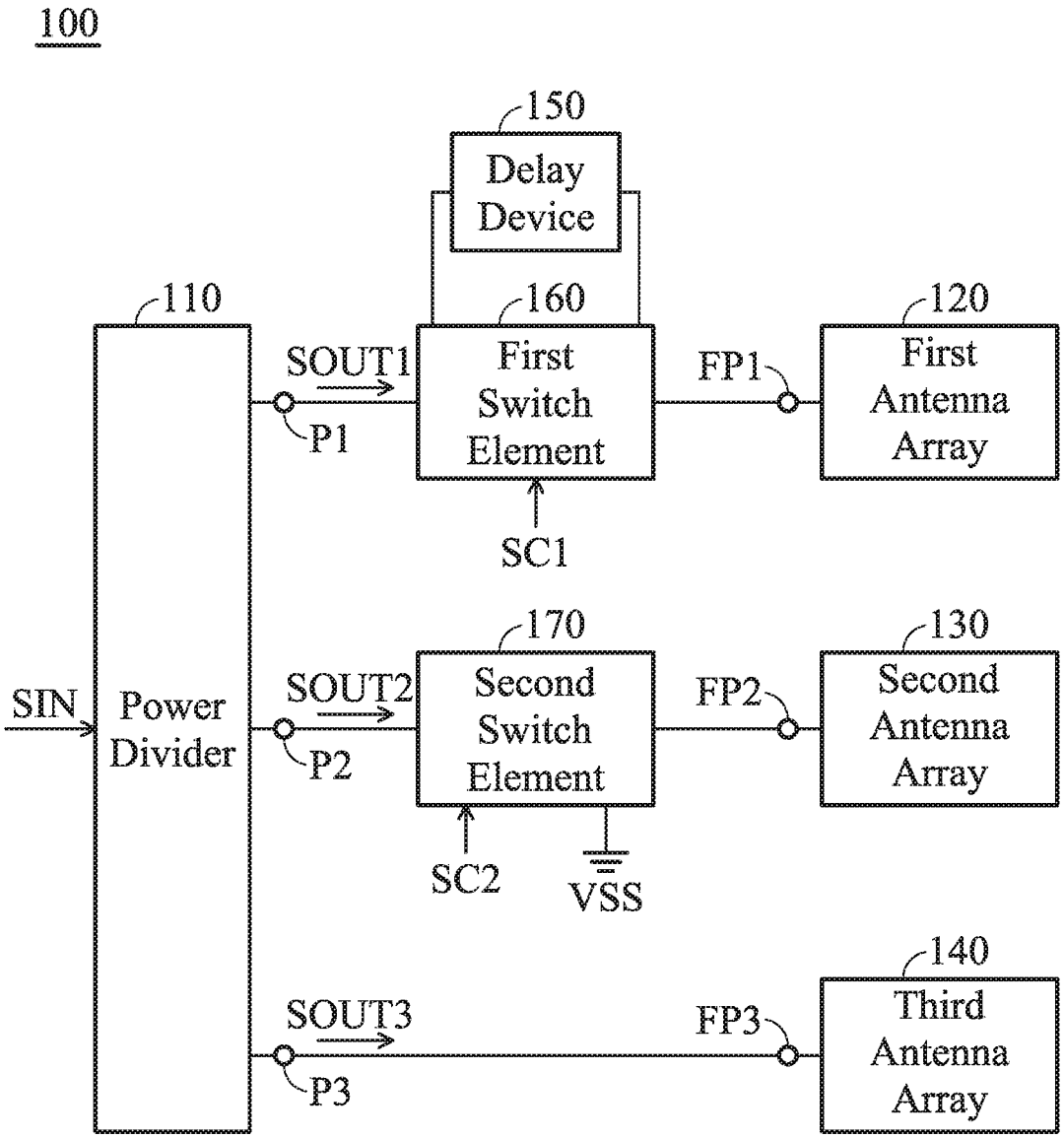
FIG. 1A is a diagram of an antenna system according to an embodiment of the invention.

FIG. 1A is a diagram of an antenna system 100 according to an embodiment of the invention. The antenna system 100 may be applicable to a communication device, such as a vehicle radar or a home security device, but it is not limited thereto. In the embodiment of FIG. 1A, the antenna system 100 includes a power divider 110, a first antenna array 120, a second antenna array 130, a third antenna array 140, a delay device 150, a first switch element 160, and a second switch element 170. It should be understood that the antenna system 100 may further include other components, such as a processor, a controller, a voltage generator, and/or a battery module, although they are not displayed in FIG. 1A.

The power divider 110 has a first output port P1, a second output port P2, and a third output port P3. The power divider 110 is configured to receive an input signal SIN and then divide the input signal SIN into a first output signal SOUT1, a second output signal SOUT2, and a third output signal SOUT3. Specifically, the first output port P1, the second output port P2, and the third output port P3 of the power divider 110 are arranged for outputting the first output signal SOUT1, the second output signal SOUT2, and the third output signal SOUT3, respectively. The first output signal SOUT1, the second output signal SOUT2, and the third output signal SOUT3 may have the same power, which may be substantially equal to ⅓ times the power of the input signal SIN.

The first antenna array 120, the second antenna array 130, and the third antenna array 140 are all excited by the power divider 110. Specifically, the first antenna array 120 has a first feeding point FP1 coupled to the first output port P1 of the power divider 110, the second antenna array 130 has a second feeding point FP2 coupled to the second output port P2 of the power divider 110, and the third antenna array 140 has a third feeding point FP3 coupled to the third output port P3 of the power divider 110. The total sizes of the first antenna array 120, the second antenna array 130, and the third antenna array 140 and the types of antenna elements are not limited in the invention. For example, each of first antenna array 120, the second antenna array 130, and the third antenna array 140 may be a 1×1, 1×2, 1×5, 1×7, or 1×9 antenna array, but it is not limited thereto.

The delay device 150 may be a phase delay line. The delay device 150 is configured to selectively adjust a feeding phase of the first antenna array 120. In some embodiments, a delay phase of the delay device 150 is substantially equal to 180 degrees. In alternative embodiments, the delay phase of the delay device 150 is substantially equal to 45, 90, 135, 225 or 270 degrees. The first switch element 160 determines whether to couple the first output port P1 and the first feeding point FP1 to the delay device 150 according to a first control signal SC1. The second switch element 170 determines whether to couple the second output port P2 and the second feeding point FP2 to a ground voltage VSS according to a second control signal SC2. For example, the first control signal SC1 and the second control signal SC2 may be generated by a processor of the antenna system 100 according to a user's input, environmental information or computer instructions (not shown).

In some embodiments, the antenna system 100 operates in a first mode and a second mode, which correspond to different radiation patterns. When the antenna system 100 operates in the first mode, the first output port P1 of the power divider 110 is directly coupled to the first feeding point FP1 of the first antenna array 120 (without communicating through the delay device 150) by using the first switch element 160, and the second output port P2 of the power divider 110 and the second feeding point FP2 of the second antenna array 130 are not coupled to the ground voltage VSS by using the second switch element 170, such that the antenna system 100 can generate a first radiation pattern. Conversely, when the antenna system 100 operates in the second mode, the first output port P1 of the power divider 110 is coupled through the delay device 150 to the first feeding point FP1 of the first antenna array 120 by using the first switch element 160, and the second output port P2 of the power divider 110 and the second feeding point FP2 of the second antenna array 130 are coupled to the ground voltage VSS by using the second switch element 170, such that the antenna system 100 can generate a second radiation pattern. The second radiation pattern may be different from the first radiation pattern. With such a design, the invention uses a single antenna system, which can generate an adjustable radiation pattern without increasing additional antenna area, so as to meet a variety of requirements of practical applications.

Figure 1B:
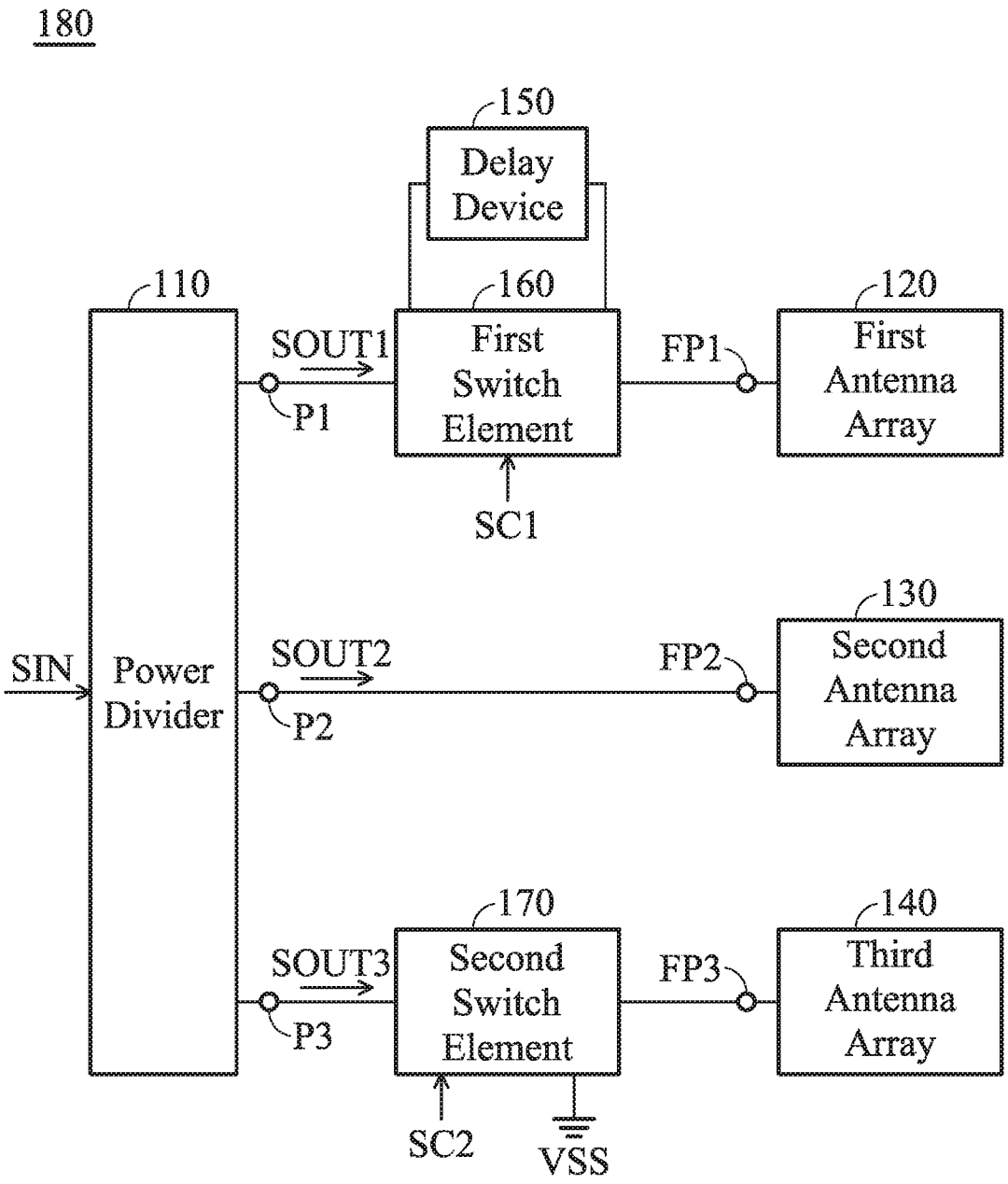
FIG. 1B is a diagram of an antenna system according to another embodiment of the invention.

FIG. 1B is a diagram of an antenna system 180 according to another embodiment of the invention. FIG. 1B is similar to FIG. 1A. In the embodiment of FIG. 1B, the position of the second switch element 170 is changed, and the second output port P2 of the power divider 110 is directly coupled to the second feeding point FP2 of the second antenna array 130. The antenna system 180 also operates in a first mode and a second mode. When the antenna system 180 operates in the first mode, the first output port P1 of the power divider 110 is directly coupled to the first feeding point FP1 of the first antenna array 120 (without communicating through the delay device 150) by using the first switch element 160, and the third output port P3 of the power divider 110 and the third feeding point FP3 of the third antenna array 140 are not coupled to the ground voltage VSS by using the second switch element 170, such that the antenna system 180 can generate a first radiation pattern. Conversely, when the antenna system 180 operates in the second mode, the first output port P1 of the power divider 110 is coupled through the delay device 150 to the first feeding point FP1 of the first antenna array 120 by using the first switch element 160, and the third output port P3 of the power divider 110 and the third feeding point FP3 of the third antenna array 140 are coupled to the ground voltage VSS by using the second switch element 170, such that the antenna system 180 can generate a second radiation pattern. Other features of the antenna system 180 of FIG. 1B are similar to those of the antenna system 100 of FIG. 1A. Accordingly, the two embodiments can achieve similar levels of performance.

The following embodiments will introduce the circuitry and structure of the proposed switch element and antenna array. It should be understood that these figures and descriptions are merely exemplary, rather than limitations of the invention.

Figure 2:
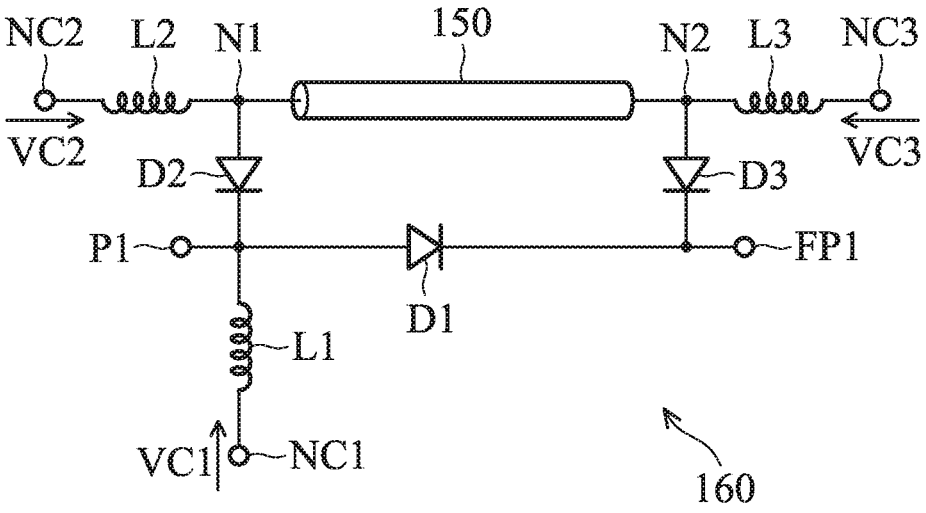
FIG. 2 is a diagram of a first switch element according to an embodiment of the invention.

FIG. 2 is a diagram of the first switch element 160 according to an embodiment of the invention. In the embodiment of FIG. 2, the first switch element 160 at least includes a first diode D1, a second diode D2, and a third diode D3. Specifically, the first control signal SC1 includes a first control voltage VC1, a second control voltage VC2, and a third control voltage VC3. The first diode D1, the second diode D2, and the third diode D3 may be three PIN diodes controlled by the first control voltage VC1, the second control voltage VC2, and the third control voltage VC3. The first diode D1 has an anode coupled to the first output port P1, and a cathode coupled to the first feeding point FP1. The second diode D2 has an anode coupled to the first node N1, and a cathode coupled to the first output port P1. The third diode D3 has an anode coupled to a second node N2, and a cathode coupled to the first feeding point FP1. The delay device 150 has a first terminal coupled to the first node N1, and a second terminal coupled to the second node N2. By controlling the first diode D1, the second diode D2, and the third diode D3, the first output port P1 of the power divider 110 is selectively coupled through the delay device 150 to the first feeding point FP1 of the first antenna array 120.

In some embodiments, the first switch element 160 further includes a first inductor L1, a second inductor L2, and a third inductor L3. The first inductor L1 is coupled between the first output port P1 and the first control node NC1. The first control node NC1 is arranged for receiving the first control voltage VC1. The second inductor L2 is coupled between the first node N1 and a second control node NC2. The second control node NC2 is arranged for receiving the second control voltage VC2. The third inductor L3 is coupled between the second node N2 and a third control node NC3. The third control node NC3 is arranged for receiving the third control voltage VC3. The first inductor L1, the second inductor L2, and the third inductor L3 are configured to filter out high-frequency noise. For example, the inductance of each of the first inductor L1, the second inductor L2, and the third inductor L3 may be greater than 10 nH. In some embodiments, any of the first inductor L1, the second inductor L2, and the third inductor L3 is implemented with a microstrip line, such as a fan-shape transmission line, whose length may be substantially equal to 0.25 wavelength ($\lambda/4$) of a central operation frequency of the antenna system 100 (or 180).

Figure 3:
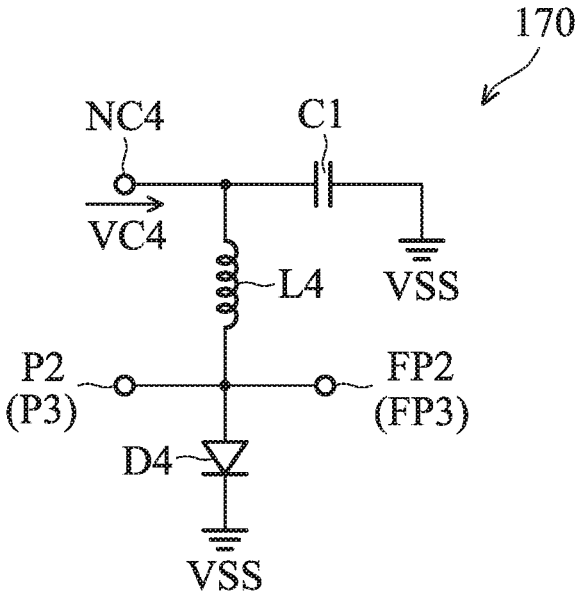
FIG. 3 is a diagram of a second switch element according to an embodiment of the invention.

FIG. 3 is a diagram of the second switch element 170 according to an embodiment of the invention. In the embodiment of FIG. 3, the second switch element 170 at least includes a fourth diode D4. Specifically, the second control signal SC2 includes a fourth control voltage VC4. The fourth diode D4 may be a PIN diode controlled by the fourth control voltage VC4. If it is applied to the antenna system 100 of FIG. 1A, the fourth diode D4 has an anode coupled to the second output port P2 and the second feeding point FP2, and a cathode coupled to the ground voltage VSS. By controlling the fourth diode D4, the second output port P2 of the power divider 110 is selectively coupled to the ground voltage VSS. If the second output port P2 of the power divider 110 is directly coupled to the ground voltage VSS, the second feeding point FP2 of the second antenna array 130 will not receive the feeding energy from the power divider 110, that is, the second antenna array 130 will be disabled.

On the other hand, if it is applied to the antenna system 180 of FIG. 1B, the fourth diode D4 has an anode coupled to the third output port P3 and the third feeding point FP3, and a cathode coupled to the ground voltage VSS. By controlling the fourth diode D4, the third output port P3 of the power divider 110 is selectively coupled to the ground voltage VSS. If the third output port P3 of the power divider 110 is directly coupled to the ground voltage VSS, the third feeding point FP3 of the third antenna array 140 will not receive the feeding energy from the power divider 110, that is, the third antenna array 140 will be disabled.

In some embodiments, the second switch element 170 further includes a fourth inductor L4 and a capacitor C1. If it is applied to the antenna system 100 of FIG. 1A, the fourth inductor L4 is coupled between the second output port P2 (or the second feeding point FP2) and a fourth control node NC4. The fourth control node NC4 is arranged for receiving the fourth control voltage VC4. If it is applied to the antenna system 180 of FIG. 1B, the fourth inductor L4 is coupled between the third output port P3 (or the third feeding point FP3) and the fourth control node NC4. The capacitor C1 is coupled between the fourth control node NC4 and the ground voltage VSS. The fourth inductor L4 is configured to filter out high-frequency noise. For example, the inductance of the fourth inductor L4 may be greater than 5 nH. The capacitor C1 is configured to filter out low-frequency noise. For example, the capacitance of the capacitor C1 may be greater than 10 pF. In some embodiments, the fourth inductor L4 is implemented with another microstrip line, such as another fan-shape transmission line, whose length may be substantially equal to 0.25 wavelength ($\lambda/4$) of the central operation frequency of the antenna system 100 (or 180).

It should be understood that the first inductor L1, the second inductor L2, the third inductor L3, the fourth inductor L4, and the capacitor C1 are optional elements, and they are omitted in other embodiments. The omitted inductor or capacitor may be replaced with a transmission line or a short-circuited path.

In some embodiments, the relative settings of the first mode and the second mode of the antenna system 100 (or 180) are described in Table I and Table II.

TABLE I

Relationship between States of Diodes and Modes of Antenna System

| | First Mode | Second Mode |
|---|---|---|
| First Diode D1 | Turned ON | Turned OFF |
| Second Diode D2 | Turned OFF | Turned ON |
| Third Diode D3 | Turned OFF | Turned ON |
| Fourth Diode D4 | Turned OFF | Turned ON |

TABLE II

Relationship between Levels of Control Voltages and Modes of Antenna System

| | First Mode | Second Mode |
|---|---|---|
| First Control Voltage VC1 | High Logic Level | Low Logic Level |
| Second Control Voltage VC2 | Low Logic Level | High Logic Level |
| Third Control Voltage VC3 | Low Logic Level | High Logic Level |
| Fourth Control Voltage VC4 | Low Logic Level | High Logic Level |

Specifically, when the antenna system 100 (or 180) operates in the first mode, the first diode D1 is turned on, but the second diode D2, the third diode D3 and the fourth diode D4 are turned off. In the first mode, the first antenna array 120, the second antenna array 130, and the third antenna array 140 are all enabled (the feeding phase of the first antenna array 120 is not delayed), and therefore the antenna system 100 (or 180) can generate a first radiation pattern including relatively centralized main beams. Conversely, when the antenna system operates in the second mode, the first diode D1 is turned off, but the second diode D2, the third diode D3, and the fourth diode D4 are turned on. In the second mode, if it is applied to the antenna system 100 of FIG. 1A, the first antenna array 120 and the third antenna array 140 are both enabled (the feeding phase of the first antenna array 120 is delayed for 180 degrees), and only the second antenna array 130 is disabled. On the other hand, in the second mode, if it is applied to the antenna system 180 of FIG. 1B, the first antenna array 120 and the second antenna array 130 are both enabled (the feeding phase of the first antenna array 120 is delayed for 180 degrees), and only the third antenna array 140 is disabled. Each of the antenna systems 100 and 180 operating in the second mode can generate a second radiation pattern including relatively disperse main beams.

Figure 4:
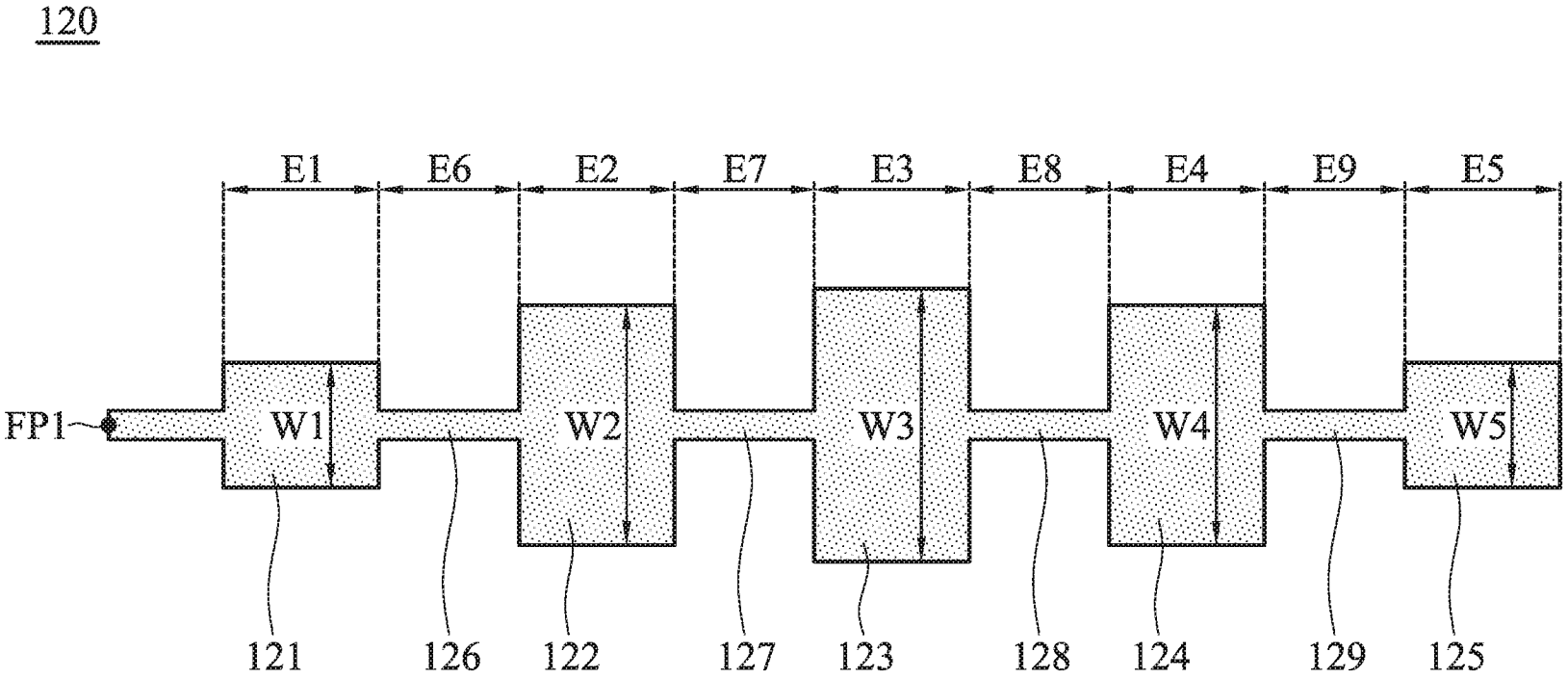
FIG. 4 is a diagram of an antenna array according to an embodiment of the invention.

FIG. 4 is a diagram of the first antenna array 120 according to an embodiment of the invention. It should be noted that the first antenna array 120, the second antenna array 130, and the third antenna array 140 have the same symmetrical structures, and FIG. 4 merely describes the first antenna array 120 as an example. In the embodiment of FIG. 4, each of the first antenna array 120, the second antenna array 130, and the third antenna array 140 includes a first radiation element 121, a second radiation element 122, a third radiation element 123, a fourth radiation element 124, a fifth radiation element 125, a first connection element 126, a second connection element 127, a third connection element 128, and a fourth connection element 129. In some embodiments, each of the first radiation element 121, the second radiation element 122, the third radiation element 123, the fourth radiation element 124, and the fifth radiation element 125 substantially has a rectangular shape, and each of the first connection element 126, the second connection element 127, the third connection element 128, and the fourth connection element 129 substantially has a straight-line shape. The first radiation element 121 is coupled to a corresponding one of the first feeding point FP1, the second feeding point FP2, and the third feeding point FP3. The fifth radiation element 125 has an open end. The first connection element 126 is coupled between the first radiation element 121 and the second radiation element 122. The second connection element 127 is coupled between the second radiation element 122 and the third radiation element 123. The third connection element 128 is coupled between the third radiation element 123 and the fourth radiation element 124. The fourth connection element 129 is coupled between the fourth radiation element 124 and the fifth radiation element 125. Generally, the first radiation element 121, the second radiation element 122, the third radiation element 123, the fourth radiation element 124, the fifth radiation element 125, the first connection element 126, the second connection element 127, the third connection element 128, and the fourth connection element 129 are all arranged in the same straight line, thereby forming a 1×5 antenna array.

In some embodiments, a central operation frequency of the first antenna array 120, the second antenna array 130, and the third antenna array 140 of the antenna system 100 (or 180) is substantially equal to 24 GHz. The element sizes of the antenna system 100 (or 180) may be as follows. The length E1 of the first radiation element 121, the length E2 of the second radiation element 122, the length E3 of the third radiation element 123, the length E4 of the fourth radiation element 124, and the length E5 of the fifth radiation element 125 may be the same, and they may all be substantially equal to 0.5 wavelength ($\lambda/2$) of the central operation frequency of the antenna system 100 (or 180). The length E6 of the first connection element 126, the length E7 of the second connection element 127, the length E8 of the third connection element 128, and the length E9 of the fourth connection element 129 may be the same, and they may all be substantially equal to 0.5 wavelength ($\lambda/2$) of the central operation frequency of the antenna system 100 (or 180). The width W3 of the third radiation element 123 may be greater than the width W2 of the second radiation element 122 and the width W4 of the fourth radiation element 124. The width W2 of the second radiation element 122 and the width W4 of the fourth radiation element 124 are both greater than the width W1 of the first radiation element 121 and the width W5 of the fifth radiation element 125 (i.e., W3>W2=W4>W1=W5). The above ranges of element sizes are calculated and obtained according to many experiment results, and they help to optimize the operation bandwidth and impedance matching of the first antenna array 120, the second antenna array 130, and the third antenna array 140.

Figure 5A:
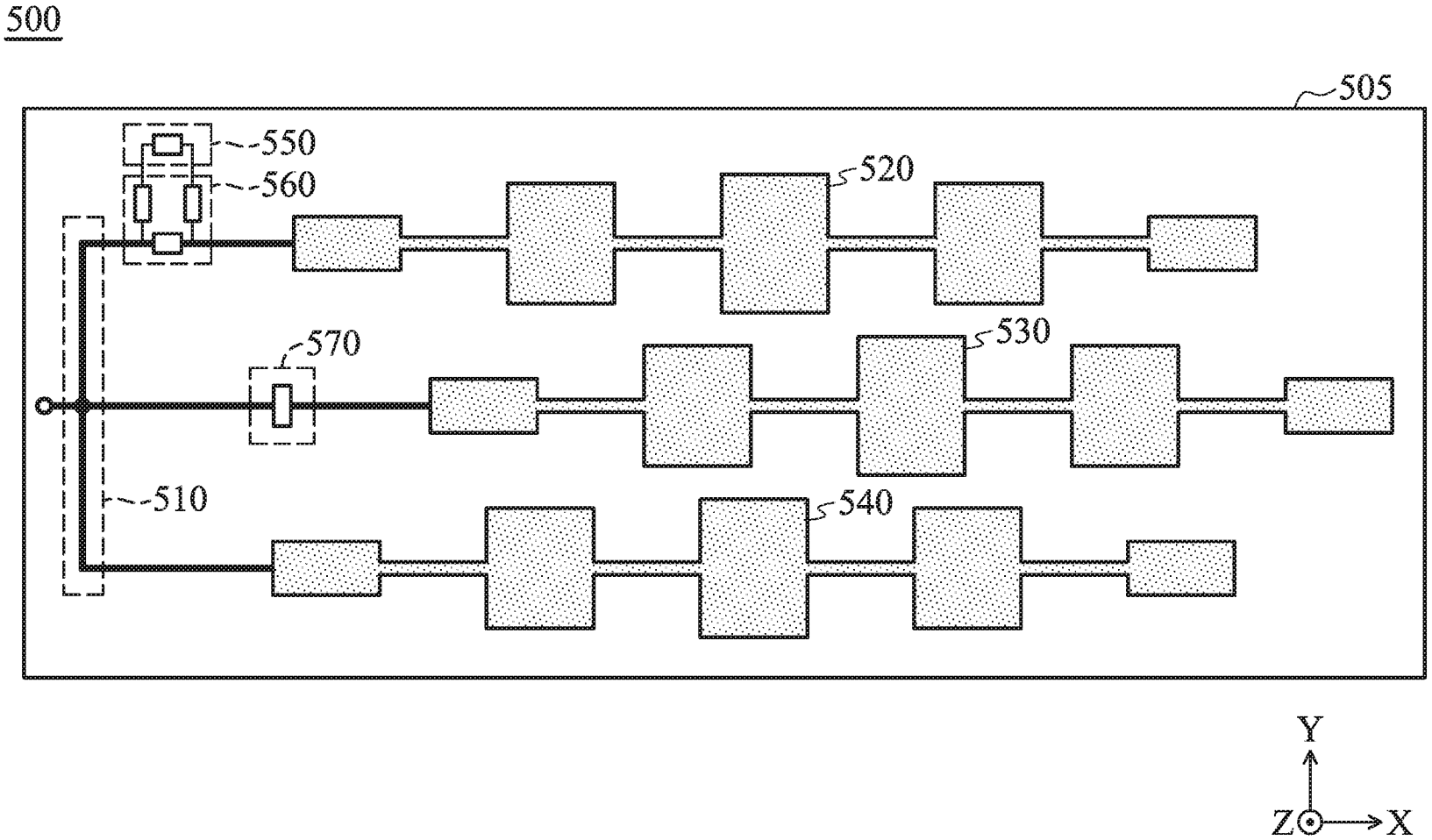
FIG. 5A is a diagram of a practical layout of an antenna system according to an embodiment of the invention.

FIG. 5A is a diagram of a practical layout of an antenna system 500 according to an embodiment of the invention. In the embodiment of FIG. 5A, the antenna system 500 includes a power divider 510, a first antenna array 520, a second antenna array 530, a third antenna array 540, a delay device 550, a first switch element 560, and a second switch element 570, and their structures and functions have been described in the embodiment of FIG. 1A. The aforementioned elements of the antenna system 500 may all be disposed on an upper surface of a dielectric substrate 505, and a ground plane may be disposed on a lower surface of the dielectric substrate 505 (not shown). A dielectric constant of the dielectric substrate 505 may be about 3.85. The thickness of the dielectric substrate 505 (i.e., the distance between the upper surface and the lower surface) may be about 10 mil. Other features of the antenna system 500 of FIG. 5A are similar to those of the antenna system 100 of FIG. 1A. Accordingly, the two embodiments can achieve similar levels of performance.

Figure 5B:
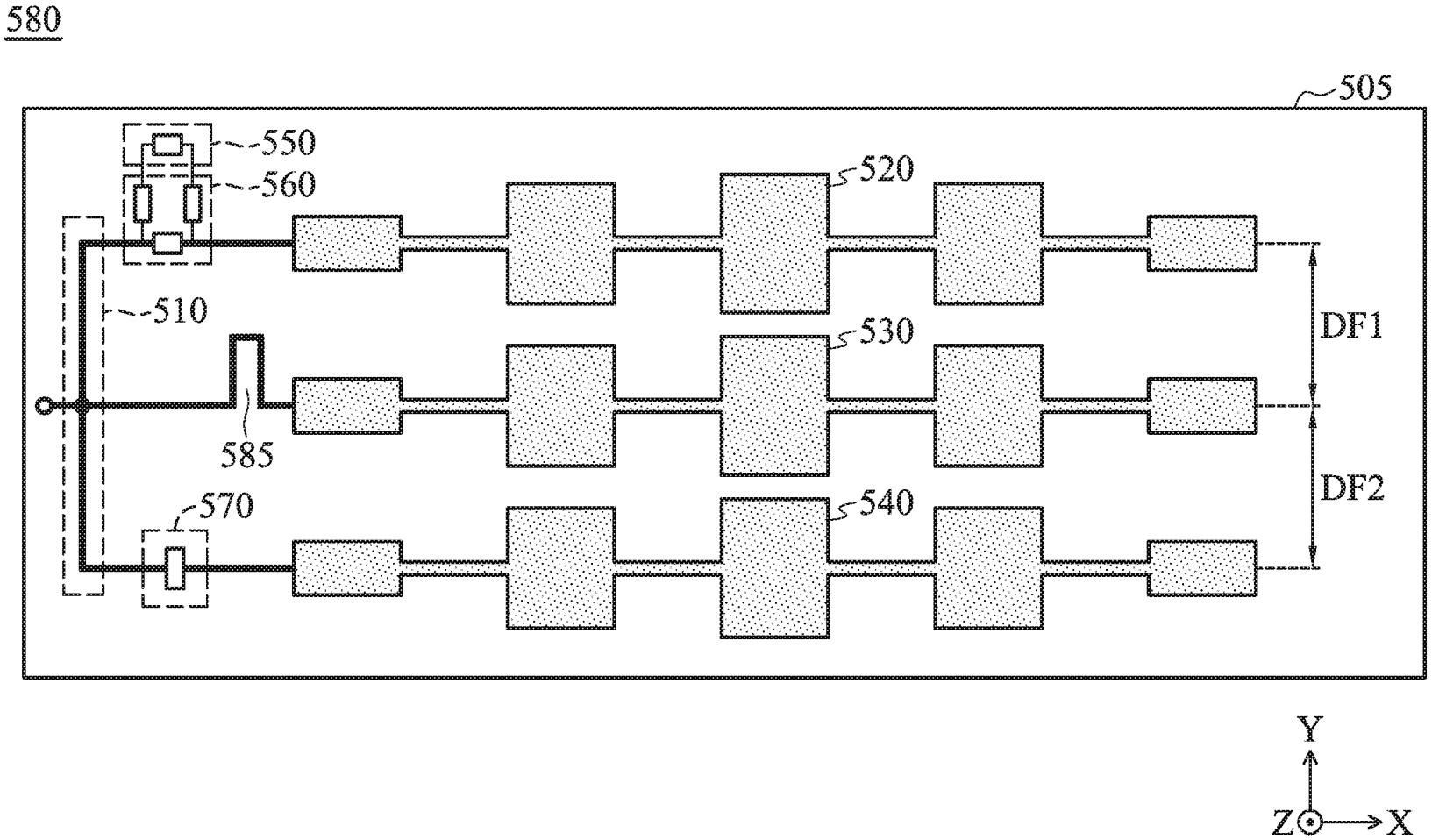
FIG. 5B is a diagram of a practical layout of an antenna system according to another embodiment of the invention.

FIG. 5B is a diagram of a practical layout of an antenna system 580 according to another embodiment of the invention. In the embodiment of FIG. 5B, the antenna system 580 also includes a power divider 510, a first antenna array 520, a second antenna array 530, a third antenna array 540, a delay device 550, a first switch element 560, and a second switch element 570, and their structures and functions have been described in the embodiment of FIG. 1B. It should be noted that the first antenna array 520, the second antenna array 530, and the third antenna array 540 of FIG. 5B are aligned with each other. The distance DF1 between the first antenna array 520 and the second antenna array 530 may be substantially equal to the distance DF2 between the second antenna array 530 and the third antenna array 540. For example, each of the distance DF1 and the distance DF2 may be substantially equal to 0.5 wavelength ($\lambda/2$) of the central operation frequency of the antenna system 580. In addition, the antenna system 580 may further include a bending transmission line 585 coupled to the second antenna array 530. The bending transmission line 585 is configured to equalize the effective feeding lengths of the first antenna array 520, the second antenna array 530, and the third antenna array 540. Other features of the antenna system 580 of FIG. 5B are similar to those of the antenna system 180 of FIG. 1B. Accordingly, the two embodiments can achieve similar levels of performance.

Figure 6A:
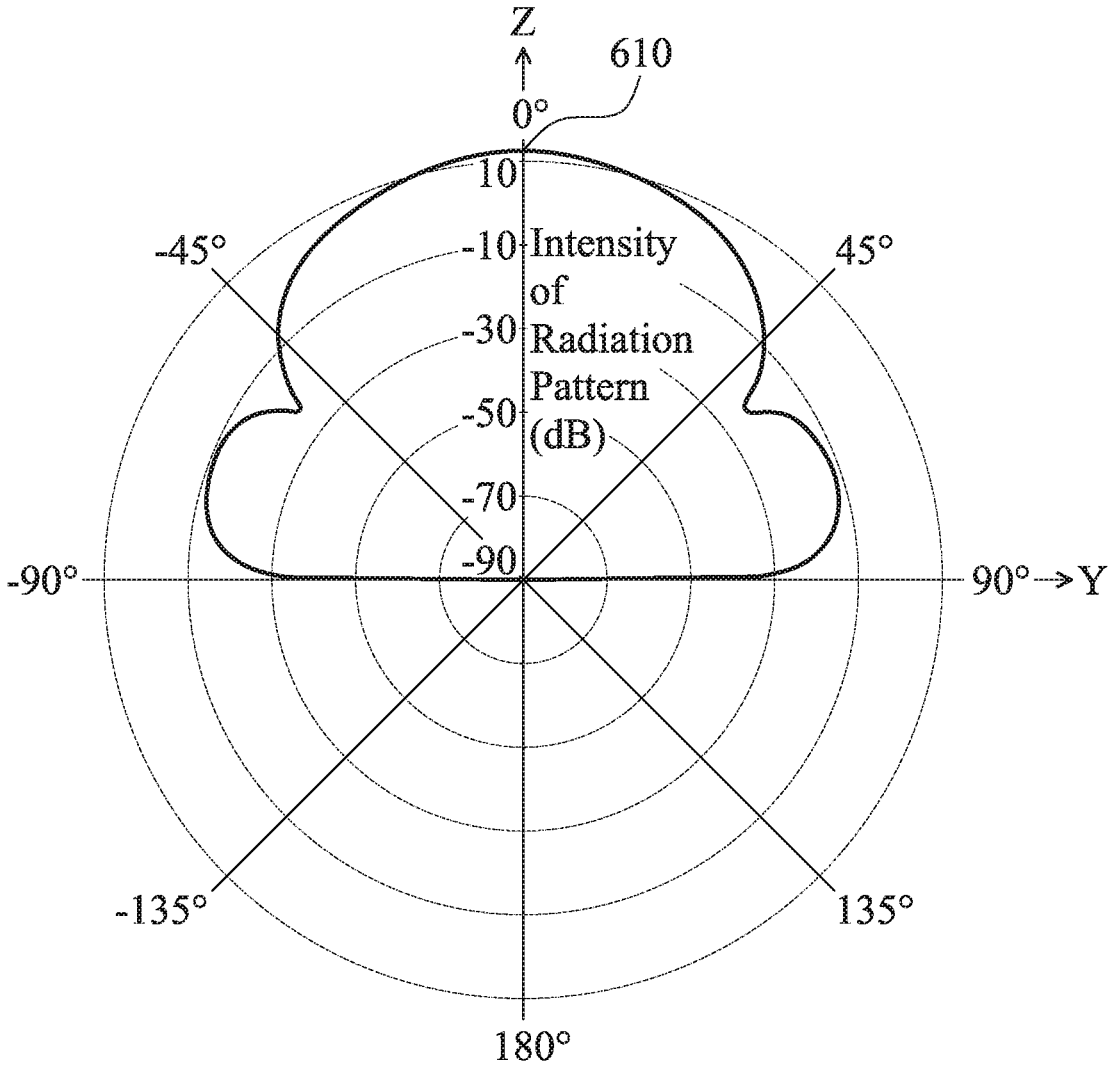
FIG. 6A is a radiation pattern of an antenna system operating in a first mode according to an embodiment of the invention.
Figure 6B:
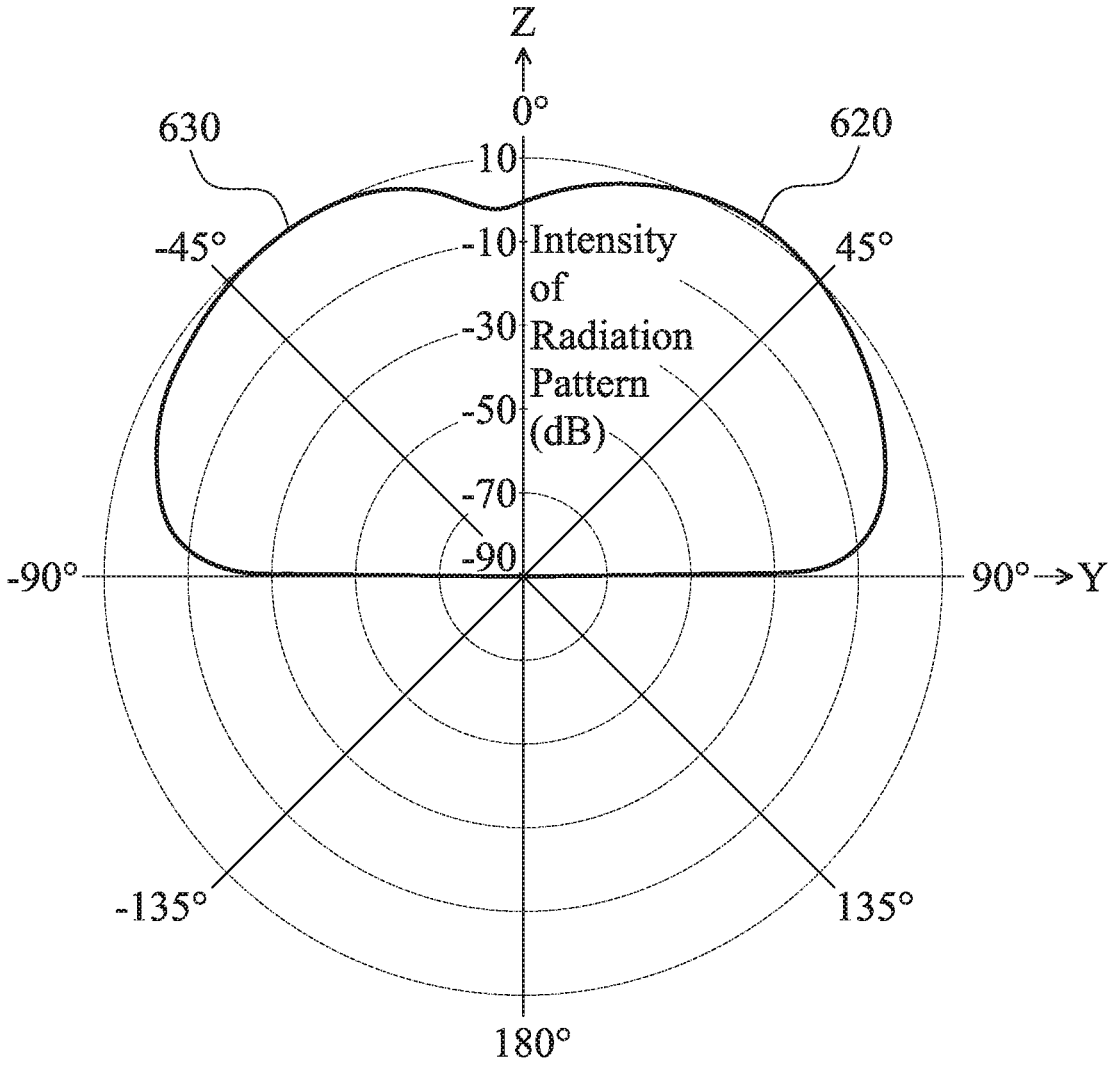
FIG. 6B is a radiation pattern of an antenna system operating in a second mode according to an embodiment of the invention.

FIG. 6A is a radiation pattern of the antenna system 580 operating in the first mode according to an embodiment of the invention (which may be measured on the YZ-plane). According to the measurement of FIG. 6A, in the first mode, the first radiation pattern of the antenna system 580 merely includes a single main beam 610, so as to provide relatively high antenna gain. FIG. 6B is a radiation pattern of the antenna system 580 operating in the second mode according to an embodiment of the invention (which may be measured on the YZ-plane). According to the measurement of FIG. 6B, in the second mode, the second radiation pattern of the antenna system 580 includes two different main beams 620 and 630, so as to provide relatively large beam widths. It should be understood that another antenna system 500 has a similar measurement result to that of FIG. 6A and FIG. 6B and is not illustrated again herein.

The invention proposes a novel antenna system including a plurality of antenna arrays and a plurality of switch elements, which are integrated with each other so as to save the design space of the antenna system. Generally, the invention has at least the advantages of adjustable radiation pattern, small size, high gain, low complexity, and low manufacturing cost, and therefore it is suitable for application in a variety of communication devices.

Note that the above element sizes, element shapes, and frequency ranges are not limitations of the invention. An antenna designer can fine-tune these settings or values to meet different requirements. It should be understood that the antenna system of the invention is not limited to the configurations of FIGS. 1-6. The invention may include any one or more features of any one or more embodiments of FIGS. 1-6. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna system, comprising:

a power divider, having a first output port, a second output port, and a third output port;

a first antenna array, coupled to the first output port;

a second antenna array, coupled to the second output port;

a third antenna array, coupled to the third output port;

a delay device;

a first switch element, determining whether to couple the first output port to the delay device according to a first control signal; and a second switch element, determining whether to couple the third output port to a ground voltage according to a second control signal.

2. The antenna system as claimed in claim 1, wherein a delay phase of the delay device is substantially equal to 180 degrees.

3. The antenna system as claimed in claim 1, wherein the first antenna array has a first feeding point, and the first control signal comprises a first control voltage, a second control voltage, and a third control voltage.

4. The antenna system as claimed in claim 3, wherein the first switch element comprises:

a first diode, wherein the first diode has an anode coupled to the first output port, and a cathode coupled to the first feeding point;

a second diode, wherein the second diode has an anode coupled to a first node, and a cathode coupled to the first output port; and a third diode, wherein the third diode has an anode coupled to a second node, and a cathode coupled to the first feeding point;

wherein the delay device is coupled between the first node and the second node.

5. The antenna system as claimed in claim 4, wherein the first diode, the second diode, and the third diode are three PIN diodes controlled by the first control voltage, the second control voltage, and the third control voltage.

6. The antenna system as claimed in claim 4, wherein the first switch element further comprises:

a first inductor, coupled between the first output port and a first control node, wherein the first control node is arranged for receiving the first control voltage;

a second inductor, coupled between the first node and a second control node, wherein the second control node is arranged for receiving the second control voltage; and a third inductor, coupled between the second node and a third control node, wherein the third control node is arranged for receiving the third control voltage.

7. The antenna system as claimed in claim 4, wherein the third antenna array has a third feeding point, and the second control signal comprises a fourth control voltage.

8. The antenna system as claimed in claim 7, wherein the second switch element comprises:

a fourth diode, wherein the fourth diode has an anode coupled to the third output port and the third feeding point, and a cathode coupled to the ground voltage.

9. The antenna system as claimed in claim 8, wherein the fourth diode is a PIN diode controlled by the fourth control voltage.

10. The antenna system as claimed in claim 8, wherein the second switch element further comprises:

a fourth inductor, coupled between the third output port and a fourth control node, wherein the fourth control node is arranged for receiving the fourth control voltage; and a capacitor, coupled between the fourth control node and the ground voltage.

11. The antenna system as claimed in claim 8, wherein when the antenna system operates in a first mode, the first diode is turned on, and the second diode, the third diode, and the fourth diode are turned off, such that the antenna system generates a first radiation pattern comprising a single main beam.

12. The antenna system as claimed in claim 8, wherein when the antenna system operates in a second mode, the first diode is turned off, and the second diode, the third diode, and the fourth diode are turned on, such that the antenna system generates a second radiation pattern comprising two different main beams.

13. The antenna system as claimed in claim 1, wherein a central operation frequency of the antenna system is substantially equal to 24 GHz.

14. The antenna system as claimed in claim 13, wherein each of the first antenna array, the second antenna array, and the third antenna array comprises:

a first radiation element;

a second radiation element;

a first connection element, coupled between the first radiation element and the second radiation element;

a third radiation element;

a second connection element, coupled between the second radiation element and the third radiation element;

a fourth radiation element;

a third connection element, coupled between the third radiation element and the fourth radiation element;

a fifth radiation element; and a fourth connection element, coupled between the fourth radiation element and the fifth radiation element.

15. The antenna system as claimed in claim 14, wherein the first radiation element, the second radiation element, the third radiation element, the fourth radiation element, the fifth radiation element, the first connection element, the second connection element, the third connection element, and the fourth connection element are arranged in the same straight line.

16. The antenna system as claimed in claim 14, wherein a length of each of the first radiation element, the second radiation element, the third radiation element, the fourth radiation element, and the fifth radiation element is substantially equal to 0.5 wavelength of the central operation frequency.

17. The antenna system as claimed in claim 14, wherein a length of each of the first connection element, the second connection element, the third connection element, and the fourth connection element is substantially equal to 0.5 wavelength of the central operation frequency.

* * * * *